United States Patent [19]

Tagliaferri

[11] 3,950,013

[45] Apr. 13, 1976

[54] SYSTEM FOR PREVENTING UNAUTHORIZED CASHING OF TRAVELERS CHECKS OR THE LIKE

[76] Inventor: Dominick P. Tagliaferri, 424 Burmont Drive, Utica, N.Y. 13502

[22] Filed: Mar. 13, 1975

[21] Appl. No.: 558,012

[52] U.S. Cl. ..... 283/6; 283/58

[51] Int. Cl.[2] ..... B42D 15/00

[58] Field of Search ..... 283/6, 7, 57, 58; 40/2 A, 40/125 A

[56] References Cited

UNITED STATES PATENTS

| | | | |
|---|---|---|---|
| 1,307,560 | 6/1919 | McQueeny | 283/6 X |
| 1,329,250 | 1/1920 | Lonson | 283/6 |
| 1,479,534 | 1/1924 | Curtis | 283/58 X |
| 1,621,865 | 3/1927 | Bacon | 283/6 |
| 2,292,272 | 8/1942 | Hirshfield | 40/125 A X |
| 3,227,473 | 1/1966 | Halbern | 283/6 X |
| 3,524,271 | 8/1970 | Buske | 283/6 X |

*Primary Examiner*—Lawrence Charles
*Attorney, Agent, or Firm*—Edward F. Connors

[57] ABSTRACT

A system for preventing unauthorized cashing of Travelers Checks or the like negotiable instruments, wherein such a check has a space for an initial comparison signature and a space for a payee signature at the time of cashing, comprises a label arrangement that is affixed over the initial signature by the seller of the check so as to sealingly overlie and completely conceal the initial signature. Such label arrangement includes a transparent plastic tape strip that has an adhesive underside protected by backing strips which are removed by the seller of the check so that the tape strip can be fixedly superimposed on the face of the check over the initial signature. The tape strip has overlying opaque covering strips adhesively affixed to its outer face which conceal the initial signature and which are peeled off from the transparent tape strip after the payee signs the check at the time of presentment so that the payor can then compare the initial signature and the signature of the person presenting the check for payment.

1 Claim, 6 Drawing Figures

SYSTEM FOR PREVENTING UNAUTHORIZED CASHING OF TRAVELERS CHECKS OR THE LIKE

BACKGROUND OF THE INVENTION

1. Field of the Invention

The present invention generally appertains to new and novel improvements in means for verifying the signature of a person signing a check, credit card or the like and especially relates to a new and novel signature identification system for Travelers Checks.

2. State of the Prior Art

The present invention has for its primary object the provision of a simple and inexpensive, yet most effective, system for curtailing the forgery and unathorized cashing of Travelers Checks and other negotiable instruments which bear an original or initial signature that is used for comparison purposes with the final signature to determine if the signor is the person who is legally entitled to sign the checks or other instruments.

Relating the invention especially to Travelers Checks, but bearing in mind that such is only one environmental usage of the present invention, it is known that, at the time of purchase, Travelers Checks are signed, usually at a space on the upper left corner portion of the face of the checks by the purchaser. At the time of presentment for cashing the checks, the person that signs on a line located around the lower left corner portion of the face of the check. The acceptor or payor of the check can then mach such presentment signature with the initial signature placed on the face of the check at the time of purchase.

However, if such Travelers Checks become lost or stolen and a wrong party attempts to cash the checks, it can be appreciated that because the orignal signature is exposed on the face of the check, a fairly competent forger could copy such signature and, as a result, cash the checks.

There have been numerous approaches in the patented art to the problem of preventing the unauthorized cashing of checks and the like. However, none come close to the simple but most effective means provided by the present invention.

For example, in U.S. Pat. No. 3,455,576, the check bears a certain marking and the payee possesses a label having a matching marking. Thus, only the person in possession of such label can cash the check.

In U.S. Pat. No. 3,227,473, the check has a concealed identification means that must be matched by the payee or person endorsing the check.

In U.S. Pat. No. 3,508,344, an opaque covering sheet overlies a base sheet with visible information thereon. Wetting of the covering sheet will cause it to become transpicuous and the information on the base sheet will then be visible.

While the foregoing show that considerable efforts have been expended in an attempt to solve the problem of unauthorized cashing of checks and the like, such are involved arrangements which make the checks of a complex nature and add considerably to the cost thereof.

In accordance with the preferred embodiment of the present invention, having regard to Travelers Checks, the purchaser of the checks signs the same in the usual fashion and such checks are of the conventional type with no charge being made in the physical structure or appearance thereof.

It is a primary object of the present invention to provide a label arrangement that is affixed by the seller of the checks, such as a bank teller, after the checks have been signed in the usual place by the purchaser. Such comparison signature is then covered over by an opaque label that hides the signature. When it is time to cash the checks, the person signs in the usual place after which the payor will peel off the label to expose the initial signature. If the signatures match, then the checks are cashed. On the other hand, if the signature is a forgery, it is impossible for the signatures to match and there would be no way by which the forger could use the initial signature as a guide. And, of course, the checks would not be honored, if the labels had been removed or tampered with.

Thus, another object of the present invention is to provide a sealed, invisible comparison signature on a check or other negotiable instrument which signature can only be properly exposed by the party honoring the check or instrument.

Another important object of the present invention is to provide an inexpensive, simple and most effective means for preventing the unauthorized cashing of checks or other negotiable instruments without unduly adding to or complicating the structure or appearance of such checks or instruments.

DESCRIPTION OF THE PREFERRED EMBODIMENTS

Figure 1:
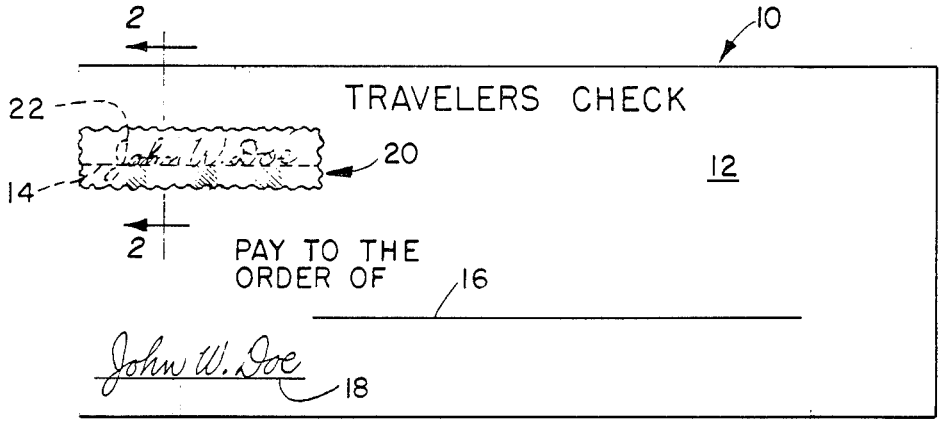
FIG. 1 is a plan view of the front face of a Travelers Check which has been provided with a label means, in accordance with the present invention, that overlies and renders invisible the initial comparison signature.
Figure 2:
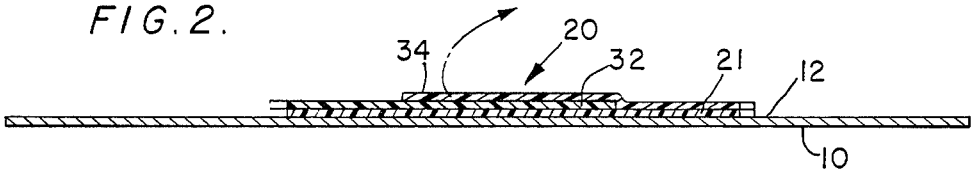
FIG. 2 is a transverse vertical sectional view taken substantially on line 2—2 of FIG. 1 and showing in section the label seal for the initial comparison signature.

Referring now more particularly to the accompanying drawing and initially to FIG. 1, the face 12 of a conventional Travelers Check 10 is shown and the same has in its upper left corner portion a line 14 on which the initial comparison signature 22 is written by the purchaser at the time of purchase. The check, as is usual, has a line 16 for the payor's name and therebelow a line 18 on which the payee affixes his signature which is compared by the person cashing the check with the initial comparison signature 22 on the line 14.

The present invention provides a simple label means 20 that renders completely sealed and invisible the comparison signature 22 until the time that the payee signs the check and presents it to the payor for payment.

Figure 6:
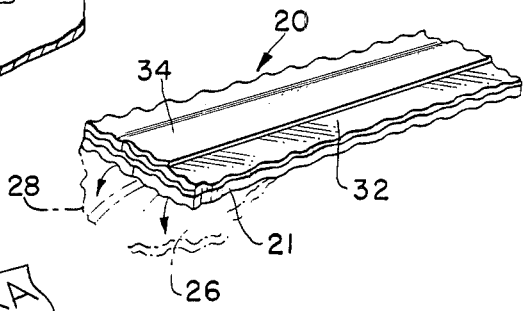
FIG. 6 is a perspective view of the initial label arrangement showing the backing strips in the process of being removed to expose the adhesive underside or face of the transparent tape strip.
Figure 5:
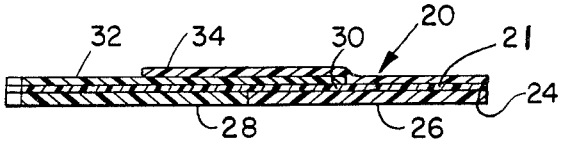
FIG. 5 is a cross-sectional view of the label arrangement in its initial form before the same has been applied over the initial comparison signature of the purchaser by the seller of the check.

Such means is shown in its initial form in FIGS. 5 and 6. As such, it comprises a strip of thin transparent plastic tape 21 which has a pressure sensitive adhesive on its underside 24. Strips 26 and 28 are secured to the adhesive underside 24 of the transparent strip 21 and completely cover the same. At the time of purchase of the checks, the seller of the Travelers Checks will remove the backing strips 26 and 28, as shown in FIG. 6, so as to expose the adhesive side 24 of the strip of tape 21.

The opposite side or outer face 30 of such transparent tape is covered by complementary cover strips 32 and 34. The strips have adhesive undersides 36, as can be appreciated from FIGS. 3 and 4. The tape 21 has scalloped side and end edges and the cover strips 32 and 34 have similar scalloped outer side and end edges. But the inner side edges are straight. The strip 36 is overlaid by the inner edge portion of the top strip 32, as can be appreciated from FIGS. 3 and 6 so that the inner straight side edges overlap.

As aforestated, the backing strips 26 and 28 are peeled off from the adhesive side 24 of the transparent tape 21 by the seller of the Travelers Check, after the purchaser has placed his signature 22 on the line 14. The selle of the check will then place the label over the signature 22. And it will be noted from FIG. 1 that the label is of a size just sufficient to overlie the initial signature 22. The opaque cover strips 32 and 34 will conceal the initial comparison signature 22.

Figure 3:
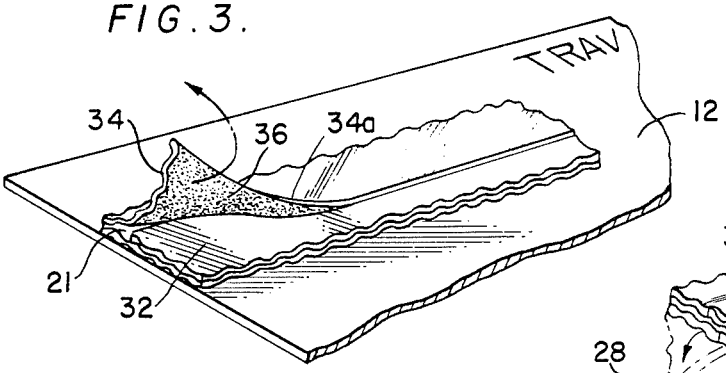
FIG. 3 is a perspective view of the upper left hand corner of the check showing the first step taken by the payor in peeling off or removing one cover strip.
Figure 4:
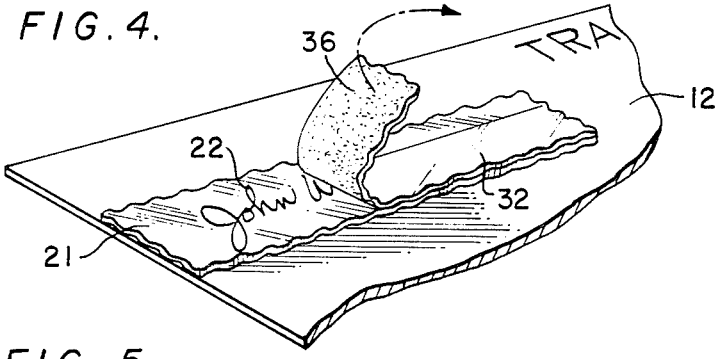
FIG. 4 is a view similar to FIG. 3 showing the second step to be taken in peeling off or removing the overlying cover strip thus exposing the initial comparison signature under the overlying protective transparent tape strip.

When it is time to cash the check, the person will sign on line 18 in the usual manner after which the payor will expose the initial comparison signature by first peeling off the top opaque cover strip 34, as shown in FIG. 3, and then peeling off the bottom opaque cover strip 32, as shown in FIG. 4. This will expose the initial comparison signature under the transparent tape 21.

It is important that the strip 34 is removed by peeling the straight inner edge 34*a* upwardly, as shown in FIG. 3, and that the bottom strip 32 is removed by peeling from the straight edge downward. In this respect, removal of the cover strips from any of their scalloped end edges or scalloped outer side edges might also cause removal of the plastic tape 21 and removal of such plastic tape could pull off the initial signature.

The scalloped edges of the tape 21 have more gripping power than straight edges which would tend to peel. Also, in manufacturing these labels it simplifies trimming the edges with a sawtoothed effect in evening all the adhered layers.

From the foregoing, it can be appreciated that a very simple, most inexpensive and efficient means has been provided to prevent unauthorized cashing of Travelers Checks or the like. In the latter respect, the invention can be used in connection with ordinary checks, credit cards or any type of negotiable instrument and will provide a foolproof method and means to prevent unauthorized transfer or cashing of such instruments.

Of course, it is to be understood that the invention, as disclosed herein and shown in the drawing, is merely the preferred form and is disclosed and shown for exemplary purposes since the invention is only limited by the appended claims.

What is claimed is:

1. For use with a Travelers Check or similar negotiable instrument having a first linear space on its face whereon a user at the tme of purchase can place an initial comparison signature and having a second linear space on its face whereon such user at the time of presentment to a payor can place his signature which the payor can compare with the signature on the first linear space to ensure that the proper person is presenting such check; a unit separate from but adapted to be attached to the check at the time of purchase thereof for preventing unauthorized cashing of such check, said unit comprising a substantially rectangular transparent strip separate from the check and adapted to be affixed to the face of the check at the time of purchase thereof with such strip being of a size so as to completely overlie and cover the first linear space and the signature thereon, said strip having an inner face and an outer face with said inner face being provided with pressure sensitive adhesive whereby the strip can be securely fastened on the face of the check over the first linear space so as to completely overlie the initial comparison signature but with such signature being visible through the strip, cover strip means secured to said inner face to protect the adhesive thereon with such cover strip means being removable to expose such face for affixing the same on the check over the first linear space, and thin opaque covering strip means adhesively fastened to and overlying the outer face of the transparent strip and being of a size and shape to complement the size and shape of the transparent strip and completely cover the outer face thereof, said cover strip means being composed of a pair of opaque thin covering strips arranged lengthwise of the transparent strip and having inner edges arranged in an overlapping arrangement so that the covering strips can be easily peeled off from the transparent strip without damaging the latter, said inner overlapping edges of the covering strips being straight and the transparent strip and the covering strips having outer scalloped side and end edges.

* * * * *